US006845718B2

(12) United States Patent
Fortner et al.

(10) Patent No.: US 6,845,718 B2
(45) Date of Patent: Jan. 25, 2005

(54) PROJECTILE CAPABLE OF PROPELLING A PENETRATOR THEREFROM AND METHOD OF USING SAME

(75) Inventors: Michael L. Fortner, Bedford, TX (US); Carl G. Baldwin, Arlington, TX (US)

(73) Assignee: Lockheed Martin Corporation, Dallas, TX (US)

( * ) Notice: Subject to any disclaimer, the term of this patent is extended or adjusted under 35 U.S.C. 154(b) by 0 days.

(21) Appl. No.: 10/325,253

(22) Filed: Dec. 18, 2002

(65) Prior Publication Data

US 2004/0118312 A1 Jun. 24, 2004

(51) Int. Cl.[7] ..... F42B 12/04; F41F 7/00

(52) U.S. Cl. ..... 102/518; 102/489; 89/8

(58) Field of Search ..... 102/374, 393, 102/476, 489, 517, 518; 89/8

(56) References Cited

U.S. PATENT DOCUMENTS

| | | | | |
|---|---|---|---|---|
| 3,842,741 A | | 10/1974 | Brothers et al. | 102/69 |
| 4,597,333 A | | 7/1986 | Bocker et al. | 102/518 |
| 4,638,737 A | | 1/1987 | McIngvale | 102/489 |
| 4,648,324 A | | 3/1987 | McDermott | 102/518 |
| 4,706,569 A | | 11/1987 | Wallow et al. | 102/518 |
| 4,756,492 A | | 7/1988 | Kranz | 244/3.1 |
| 5,059,839 A | * | 10/1991 | Rose et al. | 310/10 |
| 5,105,713 A | * | 4/1992 | Wirgau | 89/8 |
| 5,237,904 A | * | 8/1993 | Kuhlmann-Wilsdorf | 89/8 |
| 5,483,863 A | | 1/1996 | Dreizin | 89/8 |
| 6,276,277 B1 | * | 8/2001 | Schmacker | 102/384 |
| 6,696,775 B2 | * | 2/2004 | Engel | 310/135 |
| 6,766,793 B2 | * | 7/2004 | MacDougall | 124/3 |
| 2002/0166924 A1 | * | 11/2002 | Fahey | 244/121 |

FOREIGN PATENT DOCUMENTS

| | | | | |
|---|---|---|---|---|
| DE | 2500089 | * | 7/1976 | 102/489 |
| GB | 2 080 926 A | | 2/1982 | |
| GB | 2 193 561 A | | 2/1988 | |
| GB | 2 257 238 A | | 6/1993 | |

* cited by examiner

*Primary Examiner*—Michael J. Carone
*Assistant Examiner*—James S. Bergin
(74) *Attorney, Agent, or Firm*—Williams, Morgan & Amerson, P.C.

(57) ABSTRACT

A projectile includes a body, a penetrator disposed at least partially within the body for penetrating a target or barrier, and means for propelling the penetrator from the body. A method includes directing a projectile toward a target or barrier and propelling a penetrator from within a body of the projectile. An apparatus for propelling a penetrator from a projectile includes a high energy power source and means for guiding the penetrator from the projectile.

21 Claims, 5 Drawing Sheets

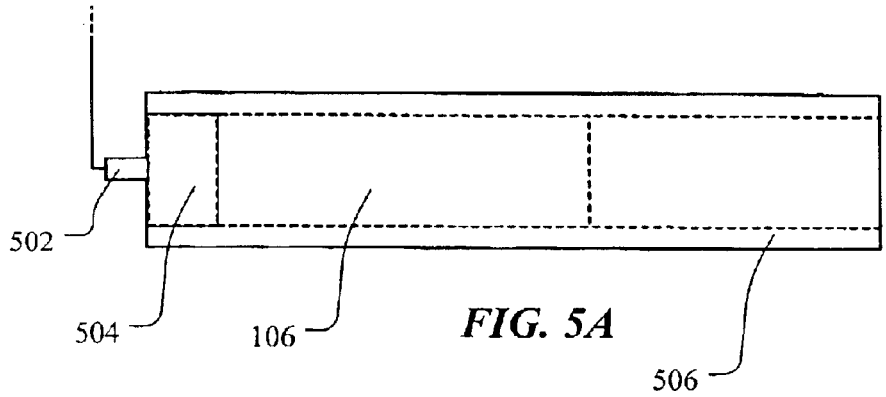
FIG. 5A
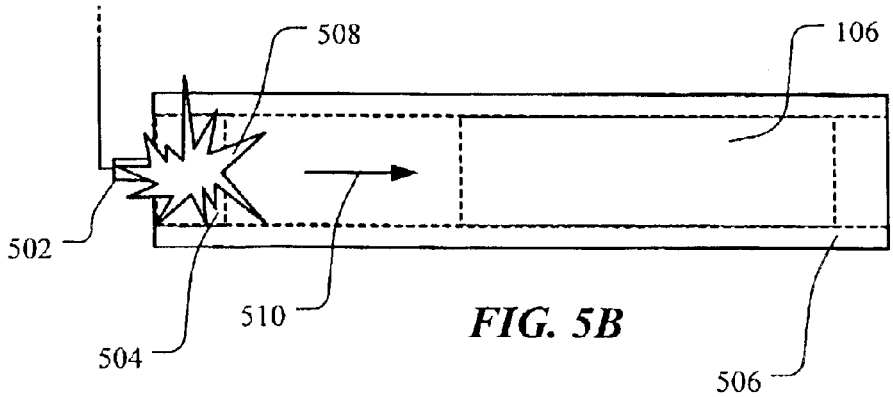
FIG. 5B
FIG. 6A
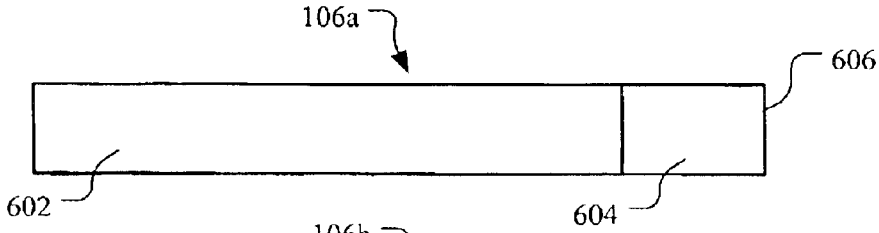
FIG. 6B
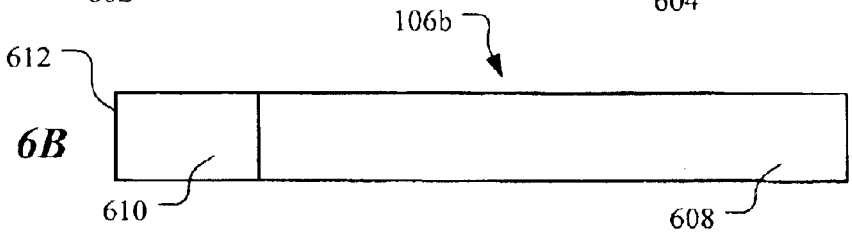
FIG. 6C
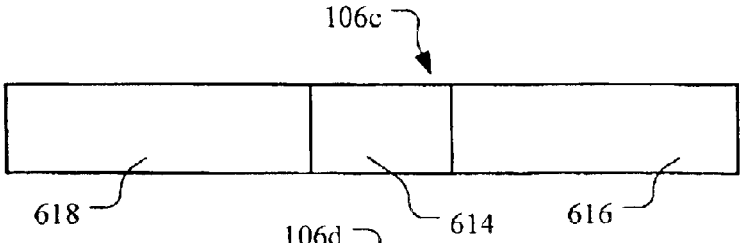
FIG. 6D
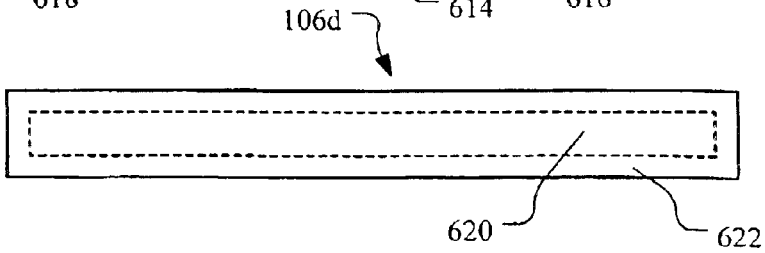

PROJECTILE CAPABLE OF PROPELLING A PENETRATOR THEREFROM AND METHOD OF USING SAME

BACKGROUND OF THE INVENTION

1. Field of the Invention

This invention relates to a projectile capable of propelling a penetrator therefrom and a method for propelling a penetrator from a projectile.

2. Description of the Related Art

In combat situations, it is often desirable to penetrate a barrier made of concrete, stone, blocks, masonry, armor, or other such materials, so that a warhead or other munition may be subsequently delivered to a target protected by barrier. Historically, some projectiles used to penetrate such barriers employ a single warhead that can penetrate the barrier and, in some situations, can also inflict damage on the target protected by the barrier. Such warheads may include large amounts of explosives to be effective, which, in turn, may increase the overall size and weight of the projectile used to deliver the warhead. If the barrier is particularly strong, the warhead's energy may be expended in penetrating the barrier with little effect on the target. Projectiles with large amounts of explosives may also inflict substantial damage on equipment and personnel proximate the point of penetration, which may be undesirable.

Projectiles have also been developed that use the projectile's kinetic energy to penetrate such barriers while carrying a warhead. Generally, such projectiles have a passive penetrator rod disposed therein that, when impacted with the barrier at great velocities, may defeat the barrier via the kinetic energy of the penetrator rod. Thus, in general, the kinetic energy projectile is propelled toward the target at great velocities (often supersonic velocities), which may require substantial fuel and a low-drag body configuration.

The present invention is directed to overcoming, or at least reducing, the effects of one or more of the problems set forth above.

SUMMARY OF THE INVENTION

In one aspect of the present invention, a projectile is provided. The projectile includes a body, a penetrator disposed at least partially within the body for penetrating a target or barrier, and means for propelling the penetrator from the body.

In another aspect of the present invention, a method is provided. The method includes directing a projectile toward a target or barrier and propelling a penetrator from within a body of the projectile.

In yet another aspect of the present invention, an apparatus for propelling a penetrator from a projectile is provided. The apparatus includes a high energy power source and means for guiding the penetrator from the projectile.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which:

FIGS. 5A and 5B are stylized, side views of a third illustrative embodiment of a propelling device according to the present invention and its operation; and FIGS. 6A–6D are stylized, side views of alternative illustrative embodiments of a penetrator according to the present invention.

Figure 1:
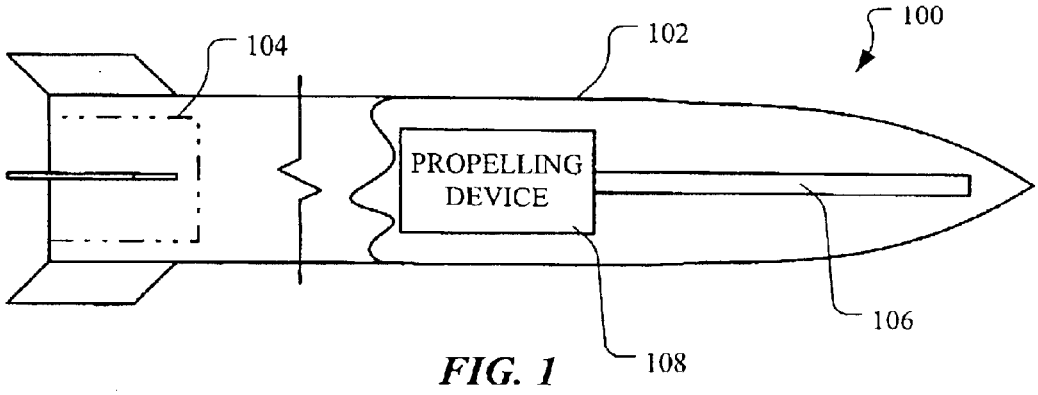
FIG. 1 is a stylized, partially cutaway, side view of an illustrative embodiment of a projectile according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1 is a stylized view of an illustrative embodiment of a projectile 100 according to the present invention. In various embodiments, the projectile 100 may be a missile, rocket, or the like and may be launched from an airborne platform, a ground-based platform, a sea-based platform, or a space-borne platform. For example, the projectile 100 may be a rocket deployed from an airplane, a drone, or a helicopter. Further, the projectile 100 may be a missile launched from a ground-based launcher or from a ship at sea. Yet further, the projectile 100 may be launched from a shoulder-mounted launcher that is carried by a person. The projectile 100 may also be launched from a satellite or other vehicle located outside the Earth's atmosphere.

In the embodiment illustrated in FIG. 1, the projectile 100 comprises a body 102 housing a motor 104 for propelling the projectile 100 toward a target and/or a barrier to the target. Thus, by way of example and illustration, the motor 104 is but one means for propelling the projectile employed in accordance with the present invention. In some embodiments, however, the motor 104 may be omitted. The projectile 100 further includes a penetrator 106 at least partially disposed within the body 102 and a propelling device 108, also housed within the body 102, for propelling the penetrator 106 from the body 102. Thus, by way of example and illustration, the propelling device 108 is but one means for propelling the penetrator employed in accordance with the present invention. While the projectile 100 and the components thereof are shown as having a particular configuration, the present invention is not so limited. Rather, the scope of the present invention encompasses various modifications to adapt the penetrator 106 and the propelling device 108 to any desired type of projectile.

Figure 2A:
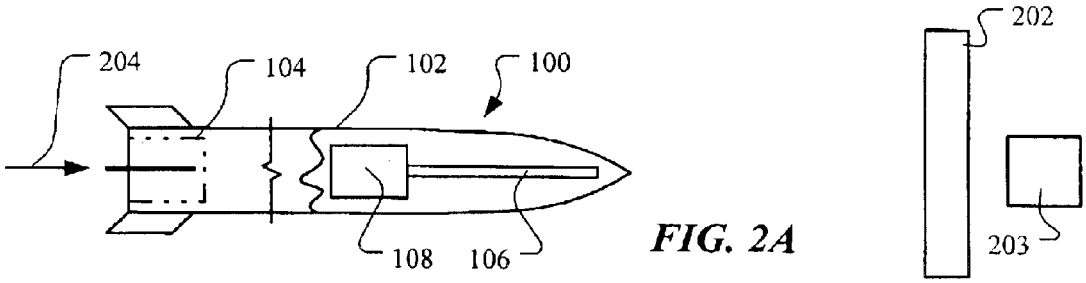
FIGS. 2A–2C are stylized, partially cutaway, side views of one illustrative embodiment of a use of the projectile of FIG. 1.
Figure 2B:
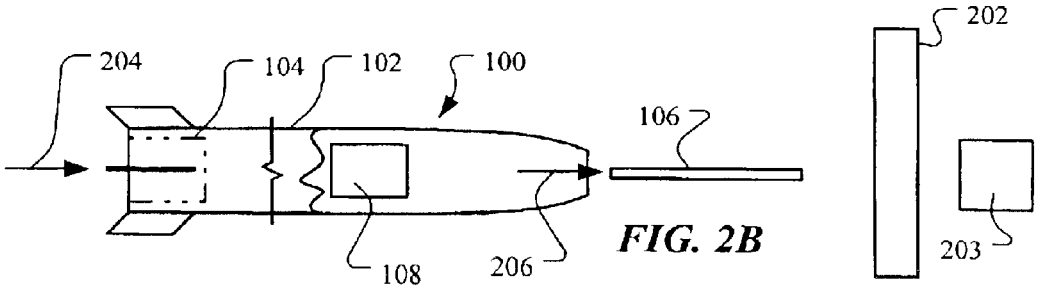
Figure 2C:
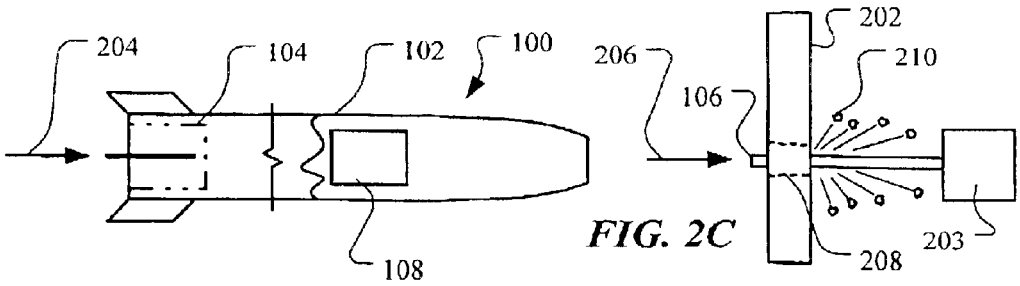

FIGS. 2A–2C are stylized views of one use of the projectile to penetrate a barrier 202 protecting a target 203. In FIG. 2A, the projectile 100 is propelled toward the barrier 202 (as indicated by an arrow 204) by the motor 104. Upon reaching a predetermined distance from the barrier 202, as shown in FIG. 2B, the propelling device 108 propels the penetrator 106 from within the body 102 (as indicated by an arrow 206) toward the barrier 202, such that the velocity of the penetrator 106 is greater than the velocity of the remaining portion of the projectile 100. The predetermined distance may be set by any means known to the art, such as a proximity sensor (not shown), a guidance system (not shown) of the projectile 100, a timing device (not shown), or the like. The penetrator 106 then impacts and penetrates the barrier 202 and impacts the target 203, as shown in FIG. 2C.

Many penetrators rely on their kinetic energy to penetrate a target and/or a barrier; thus, it is often desirable for such penetrators to impact the target or barrier at great speeds. Conventionally, the velocity of these penetrators is determined by the velocity of the projectile carrying the penetrator. However, according to the present invention, the velocity of the penetrator 106 is determined by the velocity of the projectile 100 and the additional velocity provided by the propelling device 108. Thus, it is possible for the projectile 100 to travel at a lower velocity than previous kinetic energy projectiles, while still delivering the penetrator 106 to the target at a higher velocity.

Figure 3A:
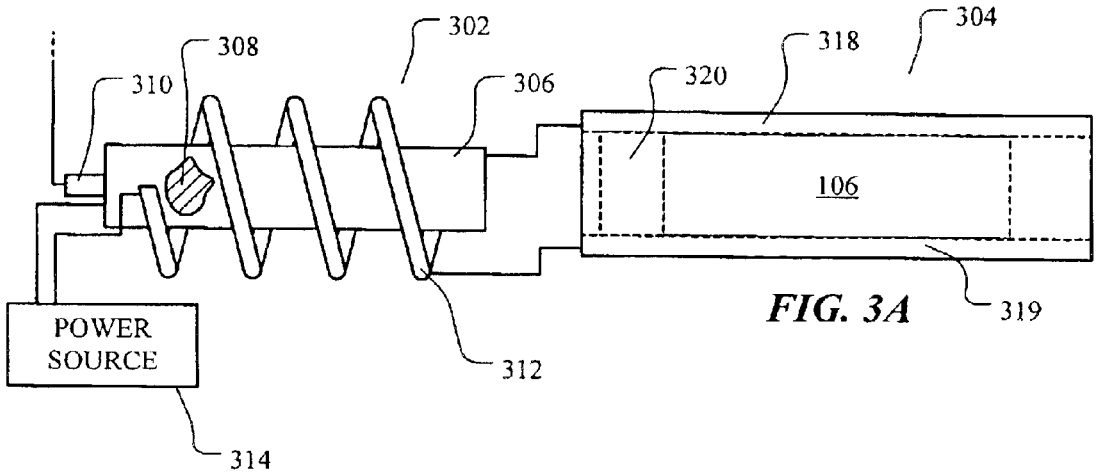
FIGS. 3A–3C are stylized side views of a first illustrative embodiment of a propelling device according to the present invention and its operation.
Figure 3B:
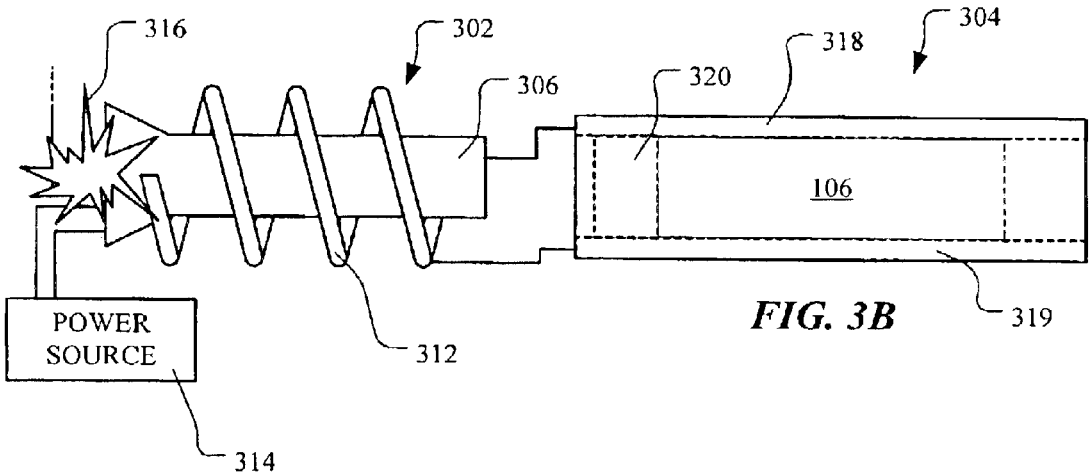
Figure 3C:
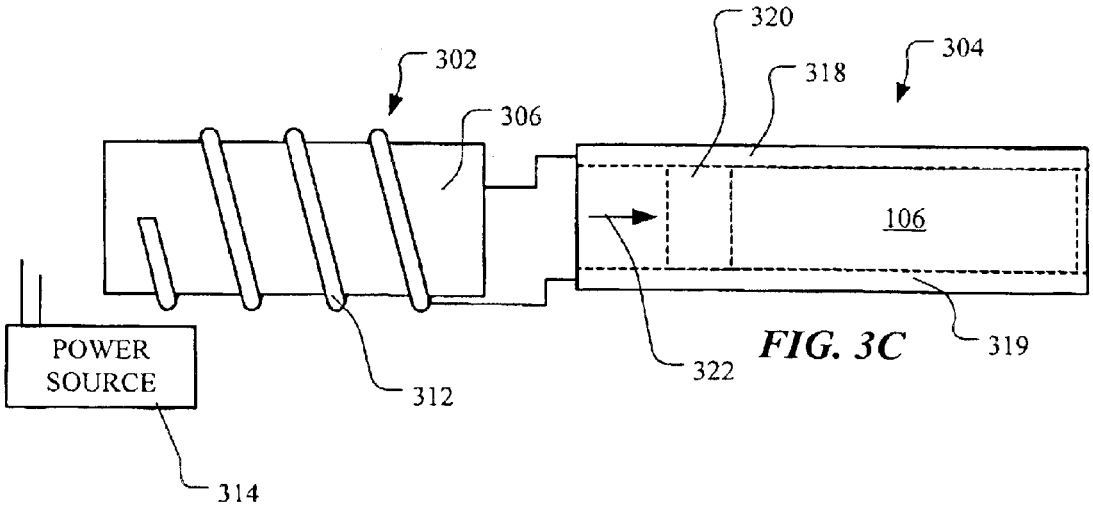

FIGS. 3A–3C depict a first illustrative embodiment of the propelling device 108 according to the present invention. In the illustrated embodiment, the propelling device 108 comprises an explosive flux compressor 302 electrically coupled with a rail gun 304, in which the penetrator 106 is disposed. The explosive flux compressor 302 includes a metallic tube 306 (or "armature") containing a high explosive material 308 (shown in FIG. 3A), such as HMX (cyclotetramethylenetetranitramine), an HMX blend, RDX (cyclotrimethylenetrinitramine), an RDX blend, LX-14 (an HMX/estane blend), TNT (trinitrotoluene) or the like, and a detonator 310 for detonating the explosive material 308. The scope of the present invention encompasses any explosive material (e.g., the explosive material 308) having a detonation reaction propagation velocity greater than the velocity at which sound propagates therethrough. In one embodiment, the explosive material 308 has a detonation reaction propagation velocity that is greater than about seven kilometers per second. In another embodiment, the explosive material has a detonation reaction propagation velocity that is greater than about nine kilometers per second.

Still referring to FIGS. 3A–3C, the tube 306 is disposed within a metallic coil 312 (or "stator"). A power source 314, electrically coupled with the explosive flux compressor 302, generates a current that flows through the tube 306 and the coil 312, generating a magnetic field therebetween.

Upon detonating the explosive material 308 within the tube 306, as shown in FIG. 3B and represented by a graphic 316, the explosive blast flares the tube 306, which then contacts the coil 312. The resulting short circuit diverts the current, and the magnetic field produced by the current, into the undisturbed coil 312 ahead of the progressing blast. As the explosive front advances, the magnetic field is compressed into a smaller volume, which creates a substantial rise in the current flowing through the coil 312 ahead of the blast. Once the explosive front has progressed through the tube 306, as shown in FIG. 3C, the current flowing through the coil 312 is transmitted to the rail gun 304.

Still referring to FIGS. 3A–3C, the rail gun 304 comprises rails 318, 319 and an armature 320 slidably disposed therebetween. The electric current produced by the explosive flux compressor 302 flows to the rails 318, 319, producing a magnetic field therebetween. The magnetic field, in turn, produces a propulsive force (as indicated by an arrow 322) on the armature 320 to propel the penetrator 106 from the rail gun 304, as shown in FIG. 3C. Thus, by way of example and illustration, the rail gun 304 is but one means for guiding the penetrator 106 from the projectile 100 employed in accordance with the present invention.

Figure 4A:
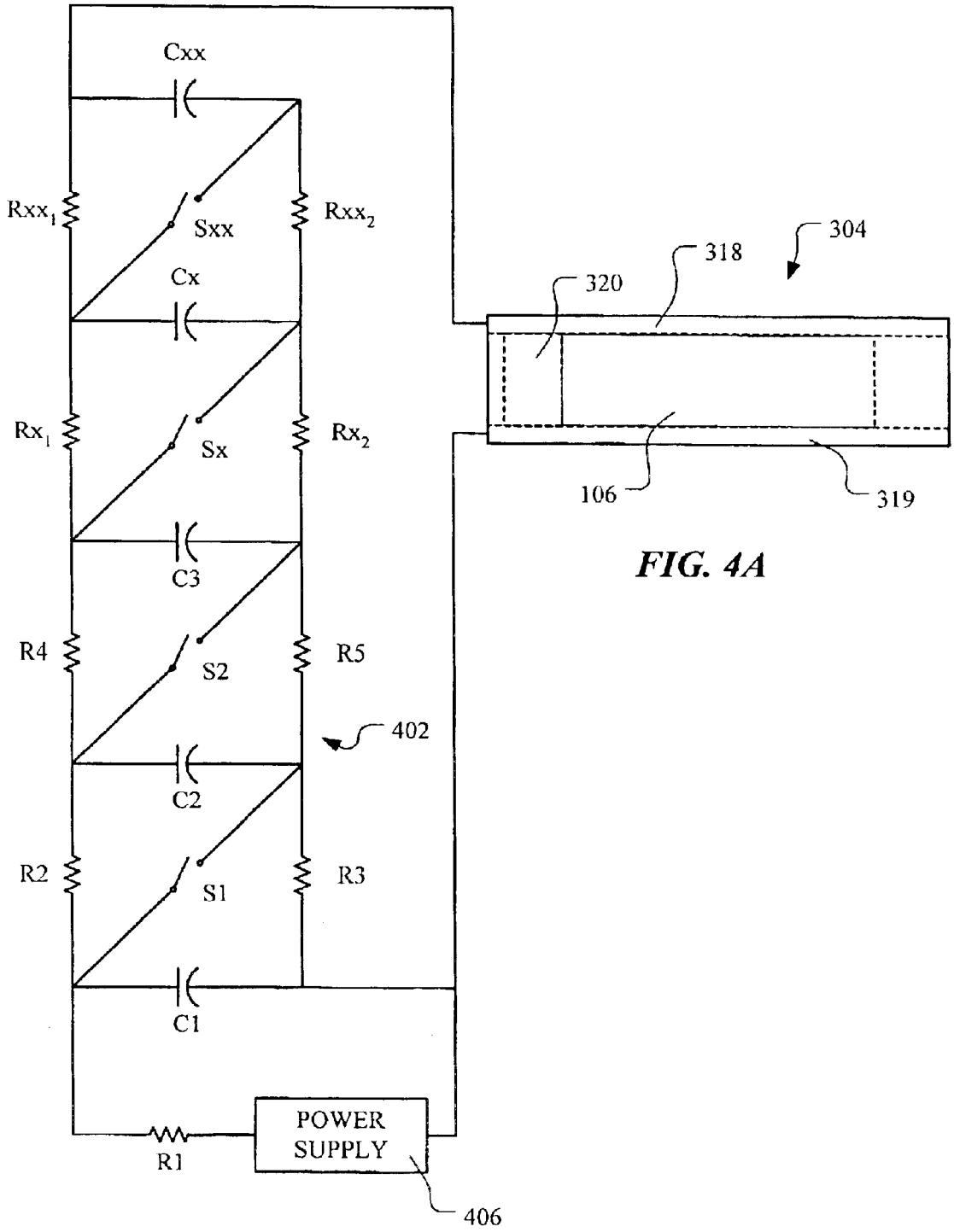
FIGS. 4A and 4B are stylized, schematic views of a second illustrative embodiment of a propelling device according to the present invention and its operation.
Figure 4B:
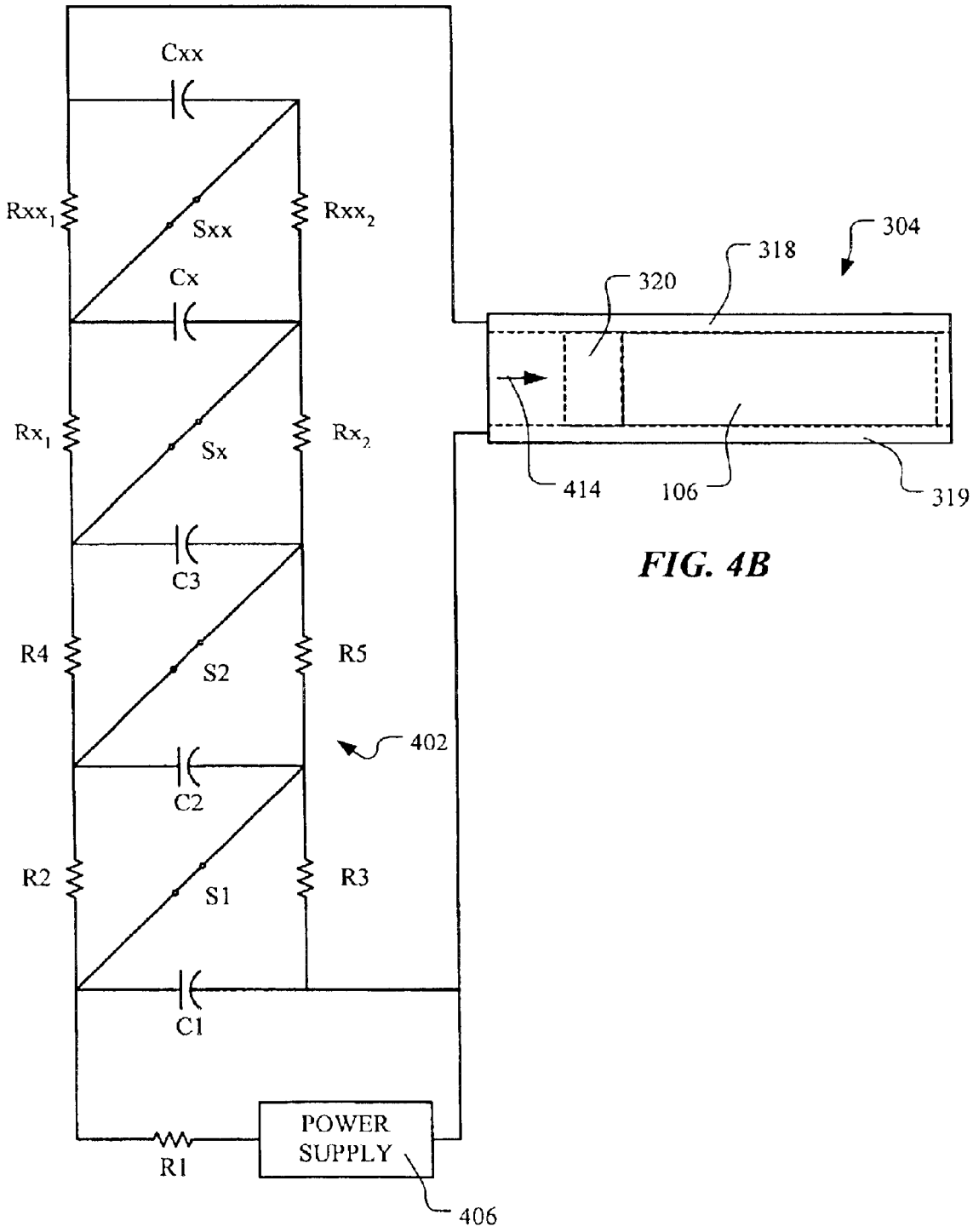

FIGS. 4A and 4B depict a second illustrative embodiment of the propelling device 108 according to the present invention. In the illustrated embodiment, the propelling device 108 comprises a Marx generator 402 electrically coupled with the rail gun 304, as described above, in which the penetrator 106 is disposed. The Marx generator 402 comprises an electrical circuit in which capacitors C1 through Cxx may be electrically charged in parallel and then discharged in series, thus outputting a much higher voltage than was inputted to the circuit. In practice, a charging voltage is applied to the circuit by a power supply 406. Once the capacitors C1–Cxx have been electrically charged, switch S1 is closed, which effectively places the capacitors C1 and C2 in series. Switch S2 is then closed, which then places the capacitors C1–C3 in series. Each of the remaining switches Sx–Sxx are then sequentially closed to finally place all of the capacitors C1–Cxx in series, as shown in FIG. 4B. The stored energy flows to the rail gun 304.

Still referring to FIGS. 4A and 4B, current produced by the Marx generator 402 flows to the rails 318, 319, producing a magnetic field therebetween. The magnetic field, in turn, produces a propulsive force (as indicated by an arrow 414) on the armature 320 to propel the penetrator 106 from the rail gun 304, as shown in FIG. 4B.

While FIGS. 4A and 4B illustrate one particular configuration of the Marx generator 402, the present invention is not so limited. Rather, the scope of the present invention encompasses modifications to the Marx generator 402 apparent to those skilled in the art having the benefit of the teachings herein. For example, the scope of the present invention encompasses modifications to the Marx generator 402 to alter the waveform of the electrical energy outputted from the Marx generator 402. Further, the switches S1–Sxx may be replaced by spark gaps such that, when the voltage within the Marx generator 402 exceeds a certain level, current flows across the spark gaps.

The scope of the present invention encompasses any high energy power source, e.g., the Marx generator 402, the explosive flux compressor 302, or an explosive charge (which will be described in more detail below), for providing a motive force to the penetrator 106. For example, the scope of the present invention encompasses a high energy power source capable of supplying electrical energy of more than 500,000 amperes of current for up to about 20 milliseconds to the rail gun 304.

Alternative to the illustrative embodiments depicted in FIGS. 3A–4B, the magnetic field produced between the rails 318, 319, 408, 410 may produce a propulsive force (as indicated by the arrows 322, 414) directly on the penetrator 106, thus propelling the penetrator 106 from the rail gun 304. In such embodiments, the armature 320, 412 may be omitted, wherein the penetrator 106 is an armature for the rail gun 304.

FIGS. 5A and 5B depict a third illustrative embodiment of the propelling device 108 according to the present invention. In the illustrated embodiment, the propelling device 108 comprises a detonator 502 coupled with an explosive charge 504. The explosive charge 504 may be any high explosive material as described above in relation to the explosive material 308, such as HMX, an HMX blend, RDX, an RDX blend, LX-14, TNT, or the like. The explosive charge 504 and the penetrator 106 are disposed within a barrel 506. In operation, the detonator 502 is fired by any means desired, as described above. Firing of the detonator 502 detonates the explosive charge 504 (indicated by a graphic 508), and the expanding gas created by the explosion propels the penetrator 106 through and out of the barrel 506 (indicated by an arrow 510), as shown in FIG. 5B. Thus, by way of example and illustration, the barrel 506 is but one means for guiding the penetrator 106 from the projectile 100 employed in accordance with the present invention.

The penetrator 106 may be a conventional kinetic energy penetrator, as shown in FIGS. 1–5B, which has a rod-like form and comprises a high-mass material, such as tungsten, a tungsten alloy, depleted uranium, steel, or the like. The penetrator 106, however, may be modified depending upon the type of target or barrier that it is intended to defeat. For example, FIGS. 6A–6D are side plan views of various alternative embodiments of the penetrator 106, which are indicated as penetrators 106*a*–106*d*. While the penetrators 106*a*–106*d* may take on any chosen shape, the illustrated embodiments have generally a rod-like form. Referring to FIG. 6A, the penetrator 106*a* includes a first portion 602 comprising a high-mass material and a warhead 604 disposed proximate a leading end 606 thereof. The warhead 604 may be of any desired type, such as an explosive warhead. In such an embodiment, the warhead 604 explodes upon contact with the target or barrier or at a predetermined point prior to contacting the target or barrier to enhance the penetration capability of the penetrator 106*a*.

Referring now to FIG. 6B, the penetrator 106*b* includes a first portion 608 comprising a high mass material and a warhead 610 disposed proximate a trailing end 612 thereof. The warhead 610 may be of any chosen type, such as an explosive warhead or an electronic countermeasures warhead. In such an embodiment, the first portion 608 impacts and penetrates the target or barrier, carrying the warhead therethrough. The warhead 610 may then be activated to defeat personnel or equipment.

In certain situations, it may be desirable to delay the arrival of a warhead portion of the penetrator 106 to a target or barrier. Thus, as shown in FIG. 6C, the penetrator 106*c* comprises a warhead 614 disposed between a leading portion 616 and a trailing portion 618 comprising a high mass material. The warhead 614 may be of any chosen type, such as an explosive warhead. In such an embodiment, the leading portion 616 impacts and penetrates the target or barrier. As the penetrator 106*c* passes through the target or barrier, the warhead 614 detonates, enlarging the opening through the target or barrier. As a result of detonating the warhead 614, the trailing portion 618 may tumble and, upon impacting the target or barrier, further enlarge the opening therethrough.

FIG. 6D illustrates the penetrator 106*d*, which comprises a warhead 620 housed within a casing 622 comprising a high mass material. The warhead 614 may be of any chosen type, such as an explosive warhead or an electronic countermeasures warhead. In such an embodiment, the penetrator 106*d* impacts and penetrates the target or barrier, carrying the warhead 614 therethrough. The warhead 614 may then be activated to defeat personnel and/or equipment.

This concludes the detailed description of the invention. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A projectile, comprising:

a body;

a rail gun disposed within the body;

a penetrator disposed within the rail gun for penetrating a target or barrier; and a high energy power source coupled with the rail gun.

2. A projectile, according to claim 1, further comprising means for propelling the body.

3. A projectile, according to claim 2, wherein the means for propelling the body comprises a motor.

4. A projectile, according to claim 1, wherein the penetrator comprises a material selected from the group consisting of steel, tungsten, a tungsten alloy, and depleted uranium.

5. A projectile, according to claim 1, wherein the penetrator further comprises a warhead.

6. A projectile, according to claim 5, wherein the warhead is disposed proximate a leading end of the penetrator, a trailing end of the penetrator, or intermediate a leading end and a trailing end of the penetrator, or within a casing.

7. A projectile, according to claim 1, wherein the penetrator further comprises a casing and a warhead disposed therein.

8. A projectile, according to claim 1, wherein the high energy power source comprises one of an explosive flux compressor and a Marx generator.

9. A projectile, according to claim 8, wherein the explosive flux compressor further comprises:

a power source;

a coil electrically coupled with the power source;

a tube electrically coupled with the power source and disposed within the coil;

an explosive charge disposed within the tube; and a detonator for detonating the explosive charge.

10. A projectile, according to claim 9, wherein the explosive charge comprises a material selected from the group consisting of cyclotetramethylenetetranitramine, a cyclotetramethylenetetranitramine blend, cyclotrimethylenetrinitramine, a cyclotrimethylenetrinitramine blend, a cyclotetramethylenetetranitramine/estane blend, and trinitrotoluene.

11. A projectile, according to claim 9, wherein the explosive charge comprises an explosive material having a detonation reaction propagation velocity greater than the velocity at which sound propagates therethrough.

12. A projectile, according to claim 9, wherein the explosive charge comprises an explosive material having a detonation reaction propagation velocity greater than about seven kilometers per second.

13. A projectile, according to claim 9, wherein the explosive charge comprises an explosive material having a detonation reaction propagation velocity greater than about nine kilometers per second.

14. A projectile, according to claim 1, wherein the rail gun further comprises an armature.

15. A projectile, according to claim 1, wherein the penetrator is an armature for the rail gun.

16. A projectile, according to claim 1, wherein the projectile further comprises a barrel in which the penetrator is disposed.

17. An apparatus for propelling a penetrator from a projectile, comprising:

a high electrical energy power source for generating an electrical current to urge the penetrator from the projectile; and means for guiding the penetrator from the projectile.

18. An apparatus, according to claim 17, wherein the high electrical energy power source further comprises one of an explosive flux compressor and a Marx generator.

19. An apparatus, according to claim 17, wherein the means for guiding the penetrator further comprised a rail gun in which the penetrator is disposed, the rail gun being electrically coupled with the high electrical energy power source.

20. An apparatus, according to claim 17, wherein the high electrical energy power source is capable of outputting electrical energy of at least 500,000 amperes for a duration of up to about 20 milliseconds.

21. An apparatus, according to claim 17, wherein the means for guiding the penetrator further comprises a barrel in which the penetrator is disposed.

* * * * *